US006037573A

United States Patent [19]

Arsenault et al.

[11] Patent Number: 6,037,573

[45] Date of Patent: Mar. 14, 2000

[54] SYSTEM AND METHOD FOR CONTROLLING THE OPERATION OF A HEATED WIPER AREA

[75] Inventors: Jeffrey S. Arsenault, Plymouth, Mich.; Martin J. Aislabie, Stratford-Upon-Avon, United Kingdom; Mark David McBroom, Northville, Mich.

[73] Assignee: Ford Motor Company, Dearborn, Mich.

[21] Appl. No.: 09/079,915

[22] Filed: May 15, 1998

[51] Int. Cl.[7] ..... H05B 1/02

[52] U.S. Cl. ..... 219/492; 219/203; 219/505

[58] Field of Search ..... 219/202, 203, 219/206, 497, 492, 493, 505, 494; 307/117; 123/179.21, 556, 198 D

[56] References Cited

U.S. PATENT DOCUMENTS

| | | | |
|---|---|---|---|
| 3,868,559 | 2/1975 | Hill et al. | 219/202 |
| 4,109,133 | 8/1978 | Hanie et al. . | |
| 4,127,763 | 11/1978 | Roselli . | |
| 4,277,672 | 7/1981 | Jones . | |
| 4,985,671 | 1/1991 | Sauer | 219/203 |
| 5,057,763 | 10/1991 | Torii et al. . | |
| 5,070,229 | 12/1991 | Takatsuka et al. . | |
| 5,107,094 | 4/1992 | Kuhn et al. | 219/202 |
| 5,187,350 | 2/1993 | Tsuchiya | 219/203 |
| 5,466,911 | 11/1995 | Spagnoli et al. . | |
| 5,482,013 | 1/1996 | Andrews et al. | 219/206 |
| 5,632,917 | 5/1997 | Cummins et al. | 219/497 |
| 5,822,978 | 10/1998 | Streit et al. | 219/202 |

*Primary Examiner*—Mark Paschall
*Attorney, Agent, or Firm*—Raymond L. Coppiellie

[57] ABSTRACT

A method and system are provided to control a heated area for a glass surface on a motor vehicle. The method and system sense the ambient temperature, determine whether the vehicle charging system is operating within a first predetermined voltage level, and disable the heated area if the charging system voltage is outside the first predetermined level.

17 Claims, 3 Drawing Sheets

SYSTEM AND METHOD FOR CONTROLLING THE OPERATION OF A HEATED WIPER AREA

BACKGROUND OF THE INVENTION

1. Technical Field

The present invention relates to a system and method for controlling a heated area on a window for a wiper rest. More particularly, the present invention relates to an automated method of controlling a heated park area on a windshield for a wiper blade on an automotive vehicle.

2. Description of the Prior Art

During cold environmental situations, ice may form on the windshield of a motor vehicle. The wiper blade may freeze within the ice and thereby prevent operation of the wiper blade or cause damage thereto upon operation of the wipers. This situation is possible in vehicles with defroster nozzles positioned in a manner which does not completely defrost the area on the windshield where the wiper parks.

U.S. Pat. No. 4,109,133 to Hänle et al. ('133 patent) describes a rear window having embedded resistance heating wires to defrost the park position of a rear window wiper blade. The heated portion is operable when a switch is manually functioned by a driver to energize the defroster wires in the rear window. Therefore the driver must operate a separate switch to activate defrosting of the wiper rest area. The '133 patent lacks a description of how the defroster operates when the voltage of the electrical system can not support operation of the defroster, in which case operation of the defroster would draw an excessive current and disable other aspects of the vehicle, including the starter.

It would therefore be desirable to provide an automatically operated heated wiper rest area. It would also be desirable to operate the heated wiper rest area with consideration of the vehicle charging system.

SUMMARY OF THE INVENTION

Accordingly, an object of the present invention is to provide a heated park area for a wiper blade in an automotive vehicle. A further objective is to provide a method of controlling the system which does not require the operator of the vehicle to activate the system. A further object is to provide a system which monitors the operation of the vehicle charging system to determine appropriate operation of the system.

Advantages of the present system include removing ice from the windshield at the park position of the wiper blade to prevent freezing thereof and therefore avoid damage to the wiper blade. A further of the advantage is that the operation of the system does not require active input from the operator of the vehicle and therefore the wiper should be free upon activation of the wiper by the operator in most situations. A further advantage is that the system determines whether the vehicle charging system is able to operate the defroster.

A method and system are provided to control a heated area for a glass surface on a motor vehicle. The method and system sense the ambient temperature, determine whether the vehicle charging system is operating within a first predetermined voltage level, and disable the heated area if the charging system voltage is outside the first predetermined level.

A method and system may also include determining whether the vehicle is running, and disabling the heater if the vehicle is not running. The method and system may also disable the heater if the ambient temperature is above a predetermined level.

DESCRIPTION OF THE PREFERRED EMBODIMENTS

Figure 1:
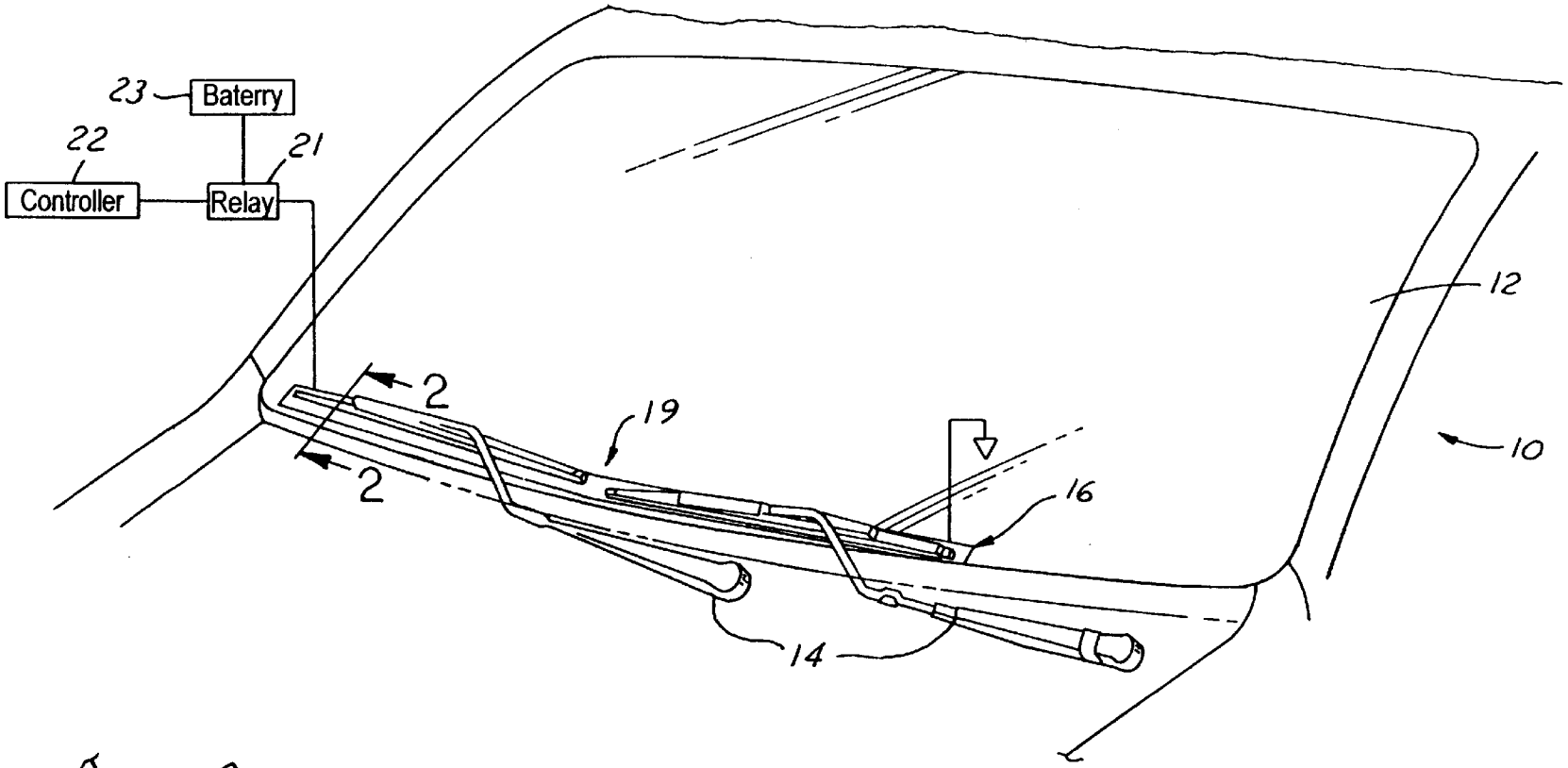
FIG. 1 is a partial view of vehicle with a windshield having a heated wiper rest according to the present invention.
Figure 2:
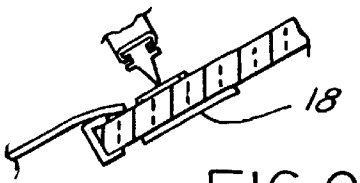
FIG. 2 is a partial cross sectional view of the wiper rest area of FIG. 1.

Referring to FIGS. 1 and 2, a motor vehicle 10 includes a front windshield 12 having a pair of windshield wipers 14. The windshield 12 includes a wiper park region 16 for the blades of the wipers 14. The park region 16 includes a film 18 for heating the park region 16 to remove ice therefrom. In some vehicles, the park region area is below the portion of the windshield heated by the front defroster and therefor ice may form in this area despite the use of a defroster. Thus, the present invention includes a heated wiper rest (HWR) area 19 to defrost this area of the windshield.

In a preferred embodiment, the HWR area 19 functions automatically without driver intervention. A button (not shown) which instructs the controller 22 to actuate a relay 21 may be provided in the instrument panel or console so the driver may actuate the HWR area 19 manually. In alternative embodiments, the HWR area 19 is operated only manually or only automatically. The HWR area 19 is preferably heated in a manner using a bus bar similar to that described in U.S. Pat. No. 5,466,911 to Spagnoli et al., assigned to the assignee of the present invention, which is incorporated herein by reference, applied to a windshield. Alternatively, the heated rest area 19 may be heated by a windshield having a grid as described in U.S. Pat. No. 4,109,133 to Hänle et al or any other manner known to one skilled in the art.

Figure 3:
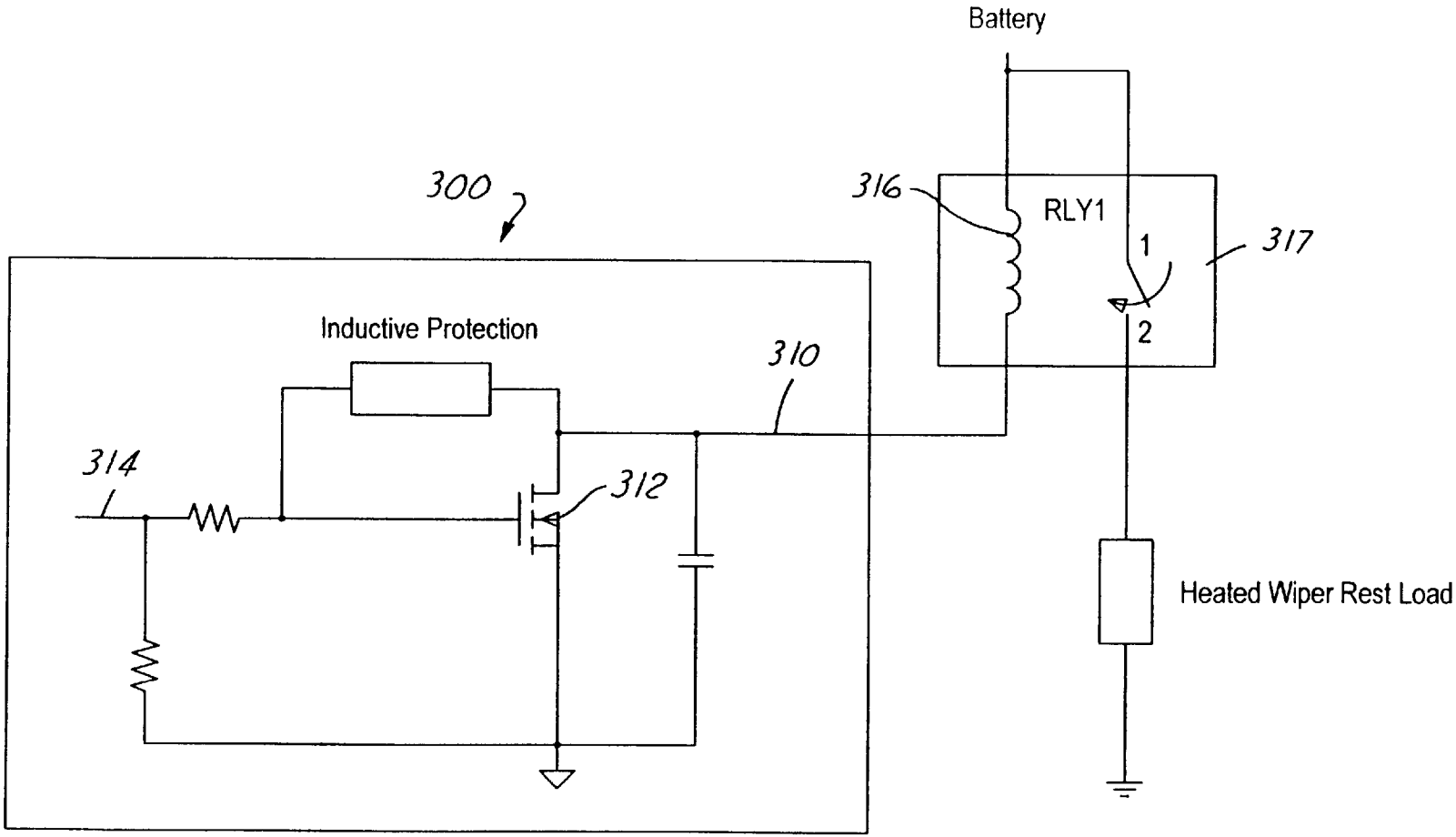
FIG. 3 is a schematic of an electrical circuit for the HWR circuit in the vehicle of FIG. 1.

The heated area is 19 controlled using a controller 22, which in a preferred embodiment is the controller for an automatic climate control system. A preferred system to control the HWR area 19 includes an electrical circuit as provided schematically in FIG. 3.

The operation of the HWR area 19 is dependent upon the ambient temperature and the vehicle operating parameters, including the ambient temperature and the condition of the electrical system of the motor vehicle. These parameters are input to the controller 22 which processes the data as described below to control the operation of the HWR area 19.

Figure 4:
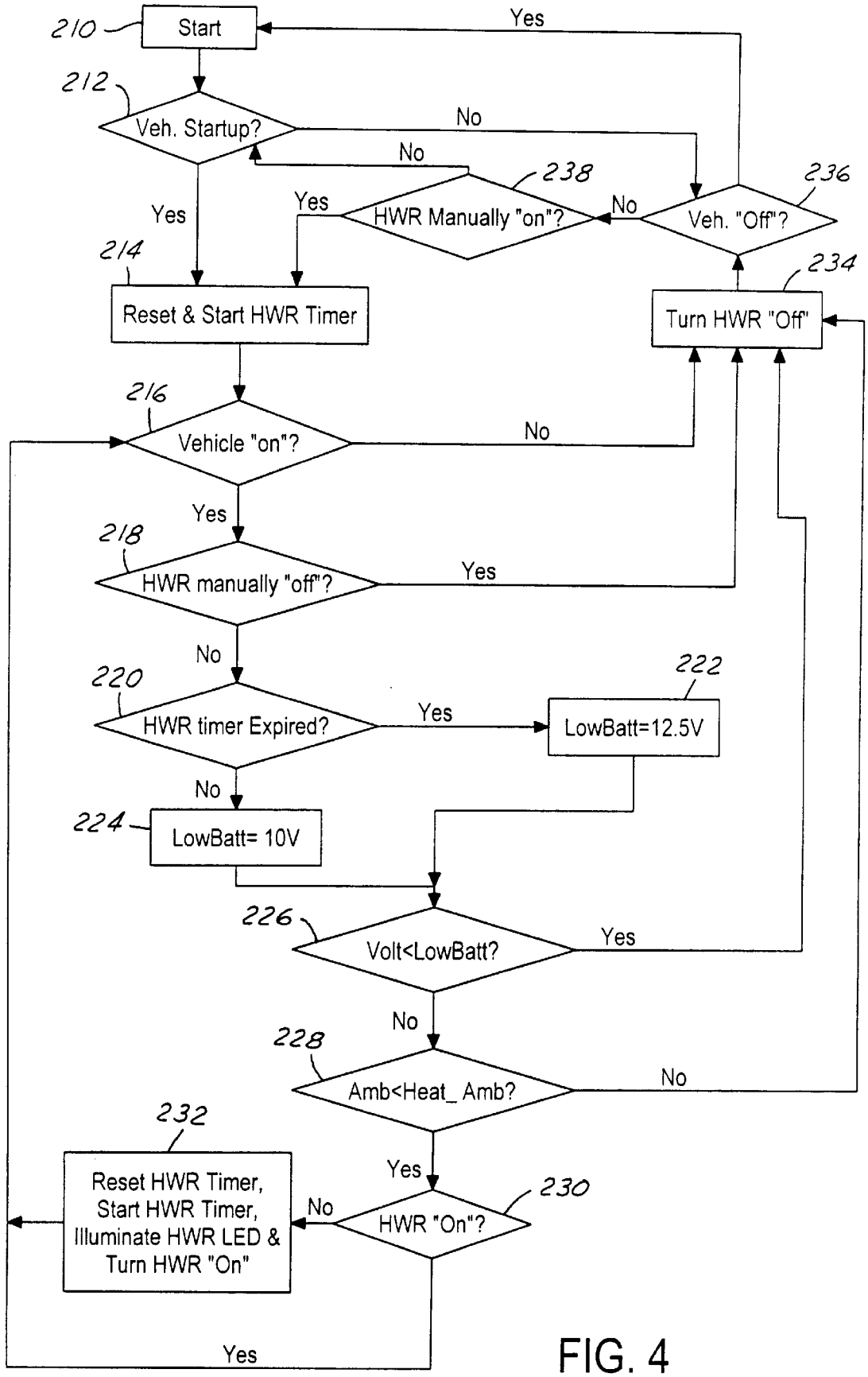
FIG. 4 is a flow chart representing the steps to determine proper operation of the system according to the present invention.

A preferred embodiment is controlled as illustrated in the Flow diagram of FIG. 4. A controller 22 performs the steps, beginning 210 by first inquiring if the vehicle is started 212. If the vehicle has not been started 212, the controller 22 determines whether the vehicle is "off" 236, preferably by measuring engine speed. In a preferred embodiment with an automatic transmission, if engine speed drops below 200 RPM, it is determined the engine is "off". This speed is determined for a particular application, and for example, with a manual transmission, a lower RPM may be desirable. In an alternative embodiment, the position of the ignition cylinder is monitored, and if the position is in any position other than "run", the HWR is turned "off".

At start-up 212, the HWR timer is reset and started 214. The minimum desired "on" time is calibratible and depends upon the particular vehicle and its intended market (for environmental parameters), and will be calibrated therefor. In a preferred embodiment, the HWR timer is set to ten minutes. The controller determines whether the vehicle is "on" 216, and if so, whether the driver shut off the HWR manually 218 using a switch (not shown). In an alternative embodiment, no switch is present and this step 218 is removed.

In a preferred embodiment, the HWR timer is continually monitored 220, and if the timer has expired, LowBatt is set to 12.0 volts at the battery; if not, LowBatt is 10.5 volts at the battery. These voltages are calibratible values which are specific to the charging system and may be set to higher or lower values for a particular system. If the vehicle voltage (Volt) falls below this threshold 226, the HWR is not turned "on", and if previously turned "on", the HWR is shut "off" 234. In a preferred embodiment, the voltage is measured at the controller 22, and therefore compensation is made for the resistance in the system between the controller 22 and battery 23, in a preferred embodiment, about 1 volt. Alternatively, the voltage is measured at the source.

If the ambient temperature (Amb) is low enough 228, in a preferred embodiment 40 degrees Fahrenheit, the system determines whether the HWR is turned "on" 230, and if not, the HWR timer is reset and started, the HWR is turned "on" and an LED or other display is illuminated to indicate to the driver that the HWR is turned "on". In an alternative embodiment, particularly where no manual switch is present, no LED is provided. In a preferred embodiment, if initially the temperature is above 40 degrees and later drops below 40 degrees Fahrenheit, the controller 22 will activate the HWR area 19.

If the vehicle is turned "off" 216 or the driver turns the HWR "off" manually 218, the voltage drops 226 below LowBatt, or ambient temperature rises 228 above a calibratible threshold, then the HWR is turned "off" 234. In a preferred embodiment, the calibratible temperature threshold is 45 degrees Fahrenheit. In an alternative embodiment, if the voltage exceeds a calibratible limit, the HWR is turned "off", or is disabled from being turned "on", depending on the state of the HWR. In a preferred embodiment, after the voltage goes outside the predetermined limits, "disabling", the HWR comprises the logic "unless the vehicle is started 212 or the HWR is manually turned "on" 238, the HWR is not automatically turned "on" again". In an alternative embodiment, the HWR may also be turned "on" if the ambient temperature falls below a calibratible limit and the voltage is within a predetermined range. In a further alternative embodiment, the HWR may not be manually turned back "on" after the voltage excursion.

In a preferred embodiment, once the HWR is turned "on", the temperature values at which the system is then commanded "off" differ from the values at which the HWR was commanded "on". For example, if the temperature is initially below 40 degrees Fahrenheit, the HWR is turned "on", but is not shut "off" unless the temperature exceeds 45 degrees Fahrenheit.

In a preferred embodiment, where a manual switch is present, if the HWR timer has not expired, after the voltage at the battery drops to a calibratible limit (in a preferred embodiment 11 volts), then the automatic operation of the HWR is disabled and only manual operation is permitted. Then, if the voltage drops below LowBatt, as described above, the HWR is turned "off". Similarly, if the HWR timer has expired and the voltage drops below 12.0 volts, the automatic HWR mode is disabled and the manual mode is retained until the voltage drops below 10 volts. In a preferred embodiment, the HWR remains "on" until the timer expires unless the lower voltage threshold is reached.

In a preferred embodiment, the controller also stores the prior state of the HWR system after the vehicle is turned "off" and restarted and the amount of time the vehicle was turned "off". If the vehicle was "off" for a time less than a calibratible time period, in a preferred embodiment ten minutes, then the HWR operates in the prior mode, either manually turned "off", manually turned "on" or automatic mode. If the HWR was previously turned "off" and the vehicle was "off" for a short time, then the flow returns to step 234. If the HWR was manually "on" and the vehicle was "off" for a short time, or if the prior state was auto mode and the vehicle was "off" for a short time, the operation returns to step 216.

Preferably, the system includes an LED on the instrument panel to indicate that the HWR area is energized. As described above, due to the large amount of electrical current draw on the vehicle power supply, preferably a determination is made whether the engine is running before the HWR may be energized.

Preferably, the system monitors vehicle battery voltage and does not permit the HWR to operate where the vehicle supply is very low, or out of regulation. In a preferred embodiment, the battery voltage is processed through a low pass filter to ensure momentary voltage transients are filtered. In a preferred embodiment, the low pass filter time constancy has a value of 1 second. A preferred low pass filter is provided mathematically in the equation and illustrated in the two graphs below.

Low pass filter equation $$IgnApp(i+1) = \frac{(IgnApp(i) * (2^{IgnFilter} - 1) + IgnNow)}{2^{IgnFilter}}, \text{ where}$$

$IgnApp$ = filtered ignition voltage (volts)

$IgnNow$ = instantaneous ignition voltage (volts)

$IgnFilter$ = filter constant(range 0–7, unitless)

Two sample graphs for the above equation are produced below. The filter is applied at some periodic rate, the rate is chosen depending on how fast the input signal is expected to change. The filter equation is the same for both charts, the only difference is the rate at which it is applied.

In a preferred climate control system, most inputs change relatively slowly. Thus, the periodic rate is chosen as 1 sec., as illustrated in the first graph below. The 1 sec. rate is also used for ignition voltage in a preferred embodiment. In further explanation, viewing the first chart (periodic rate=1 sec.), assuming the system is initially at steady state, IgnApp=IgnNow=10.0 volts. At time t=0 sec, there is a step change in ignition voltage, IgnNow, to 12.0 volts. The filter responds to this event by setting Fk=IgnFilter=6, Old Value= IgnApp=100. The chart illustrates the time based response of IgnApp (filtered ignition voltage) to the step change in measured ignition voltage.

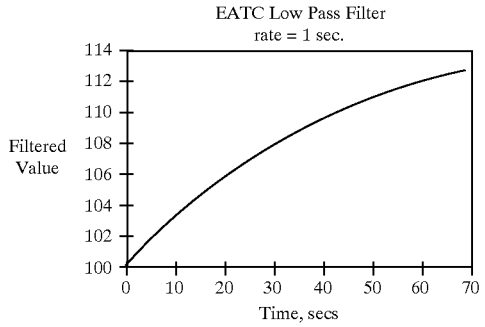

| | | |
|---|---|---|
| Filter Constant, Fk | 6 | Range is 0 to 7 |
| Old Value | 100 | |
| New Value | 120 | |

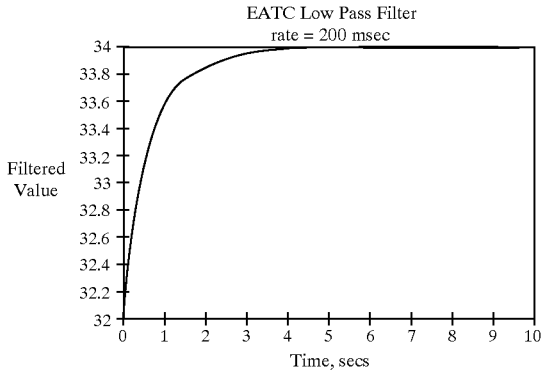

| | | |
|---|---|---|
| Filter Constant, Fk | 2 | Range is 0 to 7 |
| Old Value | 32 | |
| New Value | 34 | |

By energizing the HWR, a portion of the windshield will be defrosted as described above. In a preferred embodiment, the HWR is energized by switching it to battery via relay RLY1 316 shown in FIG. 3. RLY1 316 is activated via circuit 300 of FIG. 3 to close a switch 317 and connect the HWR load 319 to battery.

The HWR output 310 from the HVAC controller is connected to the low side of the HWR relay RLY1 316 coil. The HWR relay RLY1 316 coil high side is connected to battery voltage. To energize the HWR relay, the microprocessor (not shown in FIG. 3) will drive an output 314 with a logic high, thereby turning the transistor, 312 "on". Once the transistor 312 is turned "on", a path is provided to ground through a small resistance, Rdson associated with transistor 312. To deenergize the HWR relay, the microprocessor drives the output 314 with a logic low, which turns the transistor 312 "off", thereby placing the transistor 312 in a high impedance state. When the transistor 312 is turned "off", no current will flow through the relay coil RLY1 316 and therefore the HWR load 319 is disconnected from the battery.

Although illustrated on a windshield in FIG. 1, one skilled in the art appreciates the present invention may be applied to any window heating element, including, for example, a rear window defroster a rear window wiper rest heater, or a side window defroster.

The form of the invention shown and described herein constitutes preferred embodiments of the invention; it is not intended to illustrate all possible forms thereof. The words used are words of description rather than of limitation, and various changes may be made from that which is described here without departing from the spirit and scope of the invention.

What is claimed is:

1. A method of controlling a heated area for a glass surface on a motor vehicle comprising:

sensing the ambient temperature;

activating the heated area "on" if the ambient temperature is not above a first predetermined temperature level;

starting a timer upon activation of the heated area;

prior to expiration of the timer determining whether the vehicle charging system is operating within a first predetermined voltage level;

commanding the heated area "off" if the charging system voltage is outside the first predetermined voltage level;

upon expiration of the timer determining whether the vehicle charging system is operating within a second predetermined voltage level;

commanding the heated area "off" if the charging system voltage is outside the second predetermined voltage level.

2. The method according to claim 1, further comprising a step of filtering the charging system voltage before determining whether the vehicle charging system is operating within the first predetermined voltage level.

3. The method according to claim 1, further comprising a step of disabling the heated area if the vehicle charging system is operating outside the first predetermined voltage level.

4. The method according to claim 1, further comprising a step of disabling the heated area if the vehicle charging system is operating outside the second predetermined voltage level.

5. The method according to claim 1, further comprising a step of commanding the heated area "off" it the ambient temperature is above the first predetermined temperature level.

6. The method according to claim 1, further comprising a step of disabling the heated area if the ambient temperature is above a second predetermined temperature level.

7. The method according to claim 1 wherein the vehicle includes an engine, further comprising steps of determining whether the engine is running and disabling the heated area if the engine is not running.

8. The method according to claim 7, further comprising steps of:

providing a switch for manual operation of the heated area; and enabling manual operation of the heated area if the vehicle charging system is operating above the second predetermined voltage level and the engine is running.

9. A system for heating an area on a window of a motor vehicle, comprising:

a heating element provided on the window for localized heating thereof;

a temperature sensor to detect the ambient temperature;

a voltage sensor to determine whether a charging system of the vehicle is operating within a first predetermined voltage level;

a controller for activating said heating element when the ambient temperature is not above a first predetermined temperature level and turning said heating element "off" if the charging system voltage is outside the first predetermined voltage level; and a timer stated when said heating element is activated whereby said controller turns said heating element "off" if the vehicle charging system is operating outside a second predetermined voltage level.

10. The system according to claim 9, further comprising a filter for filtering the charging system voltage before determining whether the vehicle charging system is operating outside the first predetermined voltage level.

11. The system according to claim 9, wherein said controller disables said heating element if the vehicle charging system is operating outside the second predetermined voltage level.

12. The system according to claim 9, wherein said controller turns said heating element "off" if the ambient temperature is above the first predetermined temperature level.

13. The system according to claim 9, wherein said controller disables said heating element if the ambient temperature is above a second predetermined temperature level.

14. The system according to claim 9, further comprising a means for determining whether an engine of the vehicle is running and wherein the controller disables said heating element if the engine is not running.

15. The system according to claim 14, further comprising a switch for manual operation of said heating element, said switch enabling manual operation of said heating element if the vehicle charging system is operating above the second predetermined voltage level and the engine is running.

16. A method of controlling a heated area for a glass surface on a motor vehicle comprising:

sensing the ambient temperature;

activating the heated area "on" if the ambient temperature is not above a first predetermined temperature level;

determining whether the vehicle charging system is operating within a first predetermined voltage level;

determining whether an engine of the vehicle is running;

maintaining the heated area "on" if the charging system voltage is operating within the first predetermined voltage level, if the ambient temperature is not above the first predetermined temperature level, and if the engine is running; and disabling the heated area if the charging system voltage is outside the first predetermined voltage level, if the ambient temperature is above the first predetermined temperature level, or if the engine is not running.

17. The method according to claim 16, further comprising a step of starting a timer when the heated area is activated and disabling the heated area if the timer has expired and the charging system voltage is outside a second predetermined voltage level.

* * * * *